US009765260B2

(12) United States Patent
Jordan et al.

(10) Patent No.: US 9,765,260 B2
(45) Date of Patent: Sep. 19, 2017

(54) EXTRACTION OF OIL FROM OIL SAND

(75) Inventors: Richard D. Jordan, Vienna, VA (US); Richard H. Schlosberg, Highland Park, IL (US)

(73) Assignee: Epic Oil Extractors, LLC, Ponchatoula, LA (US)

( * ) Notice: Subject to any disclaimer, the term of this patent is extended or adjusted under 35 U.S.C. 154(b) by 412 days.

(21) Appl. No.: 13/885,985

(22) PCT Filed: Jun. 29, 2012

(86) PCT No.: PCT/US2012/044813

§ 371 (c)(1), (2), (4) Date: May 16, 2013

(87) PCT Pub. No.: WO2013/003672

PCT Pub. Date: Jan. 3, 2013

(65) Prior Publication Data

US 2013/0233772 A1 Sep. 12, 2013

Related U.S. Application Data

(60) Provisional application No. 61/502,632, filed on Jun. 29, 2011.

(51) Int. Cl.
*C10G 1/04* (2006.01)

(52) U.S. Cl.
CPC ..... *C10G 1/045* (2013.01); *C10G 2300/202* (2013.01)

(58) Field of Classification Search
CPC .... C10G 1/045; C10G 2300/202; C10G 1/00; C10G 1/04
See application file for complete search history.

(56) References Cited

U.S. PATENT DOCUMENTS

| | | | | |
|---|---|---|---|---|
| 2,281,865 A | | 5/1942 | Van Dijck | |
| 3,459,653 A | | 8/1969 | Benson | |
| 3,475,318 A | | 10/1969 | Gable et al. | |
| 3,542,666 A | | 11/1970 | Simpson | |
| 3,875,046 A | | 4/1975 | Rosenbloom | |
| 4,036,732 A | | 7/1977 | Irani et al. | |
| 4,108,760 A | * | 8/1978 | Williams | C10G 1/04 208/390 |
| 4,189,376 A | | 2/1980 | Mitchell | |
| 4,337,143 A | | 6/1982 | Hanson et al. | |
| 4,341,619 A | | 7/1982 | Poska | |
| 4,347,117 A | | 8/1982 | Bauman et al. | |

(Continued)

OTHER PUBLICATIONS

PCT/US12/44813, PCT International Search Report, Form PCT/ISA/210, dated Sep. 6, 2012, 2 pgs.

(Continued)

*Primary Examiner* — Renee Robinson
*Assistant Examiner* — Derek Mueller
(74) *Attorney, Agent, or Firm* — William H Honaker; Dickinson Wright PLLC

(57) ABSTRACT

Disclosed is a process for extracting an oil composition from oil sand. The extraction process is carried out using a fluidizing medium to fluidize oil sand particles within a contact zone in which the fluidizing medium contacts the oil sand and maintains the oil sand in the fluidized state. At least a majority of the fluidizing medium is in a vapor or supercritical state within the contact zone.

10 Claims, 2 Drawing Sheets

(56) References Cited

U.S. PATENT DOCUMENTS

| | | | | |
|---|---|---|---|---|
| 4,347,118 | A | 8/1982 | Funk et al. | |
| 4,572,777 | A | 2/1986 | Peck | |
| 4,596,651 | A | 6/1986 | Wolff et al. | |
| 4,692,238 | A | 9/1987 | Bodle et al. | |
| 4,981,579 | A * | 1/1991 | Paspek et al. | 208/314 |
| 7,384,557 | B2 | 6/2008 | Phillips et al. | |
| 7,985,333 | B2 | 7/2011 | Duyvesteyn | |
| 8,471,144 | B2 | 6/2013 | Phillips et al. | |
| 8,728,306 | B2 | 5/2014 | Ploemen et al. | |
| 8,771,502 | B2 | 7/2014 | Blackbourn et al. | |
| 2002/0134704 | A1 | 9/2002 | Mitchell et al. | |
| 2006/0076274 | A1 * | 4/2006 | Duyvesteyn | B01D 11/028 208/390 |
| 2009/0242463 | A1 * | 10/2009 | Chirinos | C10G 21/003 208/390 |
| 2009/0294332 | A1 | 12/2009 | Ryu | |
| 2011/0094961 | A1 | 4/2011 | Phillips | |
| 2012/0091041 | A1 | 4/2012 | Diefenthal et al. | |
| 2013/0020235 | A1 | 1/2013 | Filby et al. | |

OTHER PUBLICATIONS

PCT/US12/44813, PCT Written Opinion of the International Searching Authority, Form PCT/ISA/237, dated Sep. 6, 2012, 4 pgs.

M. Subramanian et al., Supercritical fluid extraction of bitumens from Utah oil sands, Dept. of Chemical and Fuels Engineering, University of Utah, Salt Lake City, 1998, No. 55, p. 35-53.

* cited by examiner

EXTRACTION OF OIL FROM OIL SAND

CROSS-REFERENCE TO PRIOR APPLICATIONS

This application claims the benefit of the filing date of PCT Application No. PCT/US2012,004813, filed Jun. 29, 2012, which claims the benefit of the filing date of U.S. Provisional Application Ser. No. 61/502,632, filed Jun. 29, 2011, each document being incorporated herein by reference in its entirety.

FIELD OF THE INVENTION

This invention relates to a process for extracting an oil composition from oil sand feed. The extraction process is carried out using a fluidizing medium comprising hydrocarbon to fluidize oil sand particles within a contact zone and extract at least a portion of the oil composition present on the oil sand feed.

BACKGROUND OF THE INVENTION

Today, most of the crude oil (known as bitumen) produced from Canadian oil sands, particular from the Athabasca region of Canada, is obtained via surface mining followed by extraction with a water based system, based on a discovery made in the 1920s, which is also referred to as the Clark process. Following extraction of the bitumen from the oil sand, a frothy water-hydrocarbon mixture must be separated. The crude oil or bitumen product that is extracted, however, is too viscous to pump. Therefore, the bitumen is frequently diluted with an organic material or diluent to render the bitumen-solvent blend pumpable. This diluted bitumen is then sent to a facility for upgrading to the desired product mix. Such a process, despite many decades of process improvement work, remains energy intensive, requires significant quantities of water that must be cleaned for re-use, and generates bottoms (known as tailings) that contain high levels of fines.

Solids from the Clark process or tailings fines require long-term storage before the fines can become trafficable and suitable for reclamation. The Energy Resources Conservation Board (ERCB) of the Canadian province of Alberta has noted in Directive 074 (February, 2009) that "in past applications, mineable oil sands operators proposed the conversion of fluid tailings into deposits that would become trafficable and ready for reclamation. While operators have applied fluid tailings reduction technologies, they have not met the targets set out in their applications; as a result, the inventories of fluid tailings that require long-term containment have grown. With each successive application and approval, public concerns have grown." In one region of interest, in Alberta, Canada, there are already several huge operations using this technology wherein the water requirements are supplied by the Athabasca River.

Hydrocarbon extraction processes have been considered as alternatives to the Clark process. For example, WO 2009/147622 discloses an oil extraction process that uses an extraction chamber and a hydrocarbon solvent rather than water to extract the oil from oil sand. The solvent is sprayed or otherwise injected onto the oil-bearing product, to leach oil out of the solid product resulting in a composition comprising a mixture of oil and solvent, which is conveyed to an oil-solvent separation chamber.

U.S. Pat. No. 4,347,118 discloses a solvent extraction process for tar sands wherein a low boiling solvent having a normal boiling point of from 20° to 70° C. is used to extract tar sands. The solvent is mixed with tar sands in a dissolution zone, the solvent:bitumen weight ratio is maintained from about 0.5:1 to 2:1. This mixture is passed to a separation zone in which bitumen and inorganic fines are separated from extracted sand, the separation zone containing a classifier and countercurrent extraction column. The extracted sand is introduced into a first fluid-bed drying zone fluidized by heated solvent vapors, so as to remove unbound solvent from extracted sand while at the same time lowering the water content of the sand to less than about 2 wt %. The treated sand is then passed into a second fluid-bed drying zone fluidized by a heated inert gas to remove bound solvent. Recovered solvent is recycled to the dissolution zone.

Although hydrocarbon extraction processes provide an advantage that water is not used in the extraction of the oil from the oil sand, thereby reducing environmental impact, a problem persists, however, in that hydrocarbon extraction has been difficult to control. For example, the degree of extraction of the oil from the oil sand has been difficult to control, as well as the ability to efficiently separate the solid material from the solvent and extracted oil. Such extraction processes are often quite time consuming, meaning they have been difficult to design at an acceptable commercial scale.

SUMMARY OF THE INVENTION

This invention provides a process for extracting an oil composition from oil sand feed that does not depend on the use of water to extract the oil. In addition, the time required for removing substantial quantities of oil from the oil sand is relatively short according to the process. The quality of the extracted oil can also be controlled as desired according to the process by adjusting such parameters as hydrocarbon quality of the fluidizing medium and/or degree of vaporization of the fluidizing medium in the contacting zone. Environmental impact of the process is relatively low in that little waste water is produced, and the extracted sand, which can be considered a waste material, will have little if any added environmental impact relative to its native state.

According to one aspect of the invention, there is provided a process for extracting an oil composition from oil sand, which includes a step of supplying a stream of oil sand to a contact zone, wherein the oil sand is comprised of at least 2 wt % of an oil composition, based on total weight of the supplied oil sand. The oil sand is fluidized in the contact zone with a fluidizing medium, which is comprised of a hydrocarbon component. At least a majority of the fluidizing medium in the contact zone is maintained in a vapor or supercritical state, and at least a portion of the oil composition is removed or extracted from the oil sand within the contact zone.

According to another aspect of the invention, there is provided a process for extracting an oil composition from oil sand that includes the steps of supplying a stream of oil sand into a contact zone, wherein the oil sand is comprised of at least 2 wt % of an oil composition, based on total weight of the supplied oil sand and contacting the oil sand in the contacting zone with a fluidizing medium, which is comprised of a hydrocarbon component, at a velocity to fluidize the oil sand. At least a portion of the oil composition is removed or extracted from the oil sand in the contacting zone, wherein at least a majority of the fluidizing medium in the contacting zone is in a vapor or supercritical state.

According to yet another aspect of the invention, the oil sand is fluidized in the contact zone with a fluidizing medium, wherein the fluidizing medium is comprised of a hydrocarbon solvent and at least a majority of the fluidizing medium in the contact zone is maintained in a vapor or supercritical state, and the contacting of the fluidizing medium with the oil sand extracts a portion of the oil from sand within the contacting zone, forming an extracted oil portion and an oil-extracted oil sand. The extracted oil portion is separated from the oil-extracted oil sand portion, and at least a portion of the separated extracted oil portion is recycled into the contact zone.

In one embodiment of the invention, the oil sand that is supplied to the contact zone has an average particle size of not greater than 20,000 microns. In another, the fluidizing medium is provided to the contact zone a superficial velocity greater than or equal to 0.1 meter per second (m/s). Alternatively, the superficial velocity is not greater than 10 m/s.

The fluidizing medium and oil sand can be supplied to the contact zone at a weight ratio of total hydrocarbon to oil sand feed of at least 0.01:1. According to the extraction process, the extracted oil portion can have an API gravity of not less than 5. Alternatively, the extracted oil portion has a sulfur content of not greater than 5 wt %, based on to total weight of the extracted oil portion.

A portion of the separated extracted oil portion can be separated from the separated extracted oil portion for use as the fluidizing medium. That is, the oil extracted from the oil sand can be further separated into a crude oil product and a hydrocarbon solvent fraction, with the crude oil product having the characteristics described further below, and the hydrocarbon solvent fraction having the characteristics of the fluidizing medium as described further below. The hydrocarbon solvent fraction can be recycled for use as the fluidizing medium, and can comprise some or all of the fluidizing medium. For example, recycled solvent fraction can comprise at least 95 wt % of the fluidizing medium in the contact zone as further described below.

The hydrocarbon solvent used according to this invention can be a partial hydrocarbon solvent. In such an instance, the contacting of the oil sand with the fluidizing medium comprising the hydrocarbon solvent provides a control extraction medium in that the extraction can result in extracting not greater than 70 wt % of the total oil composition present on the oil sand feed.

BRIEF DESCRIPTION OF THE DRAWINGS

Examples of various preferred embodiments of this invention are shown in the attached Figures, wherein.

DETAILED DESCRIPTION OF THE INVENTION

I. Introduction

Figure 1:
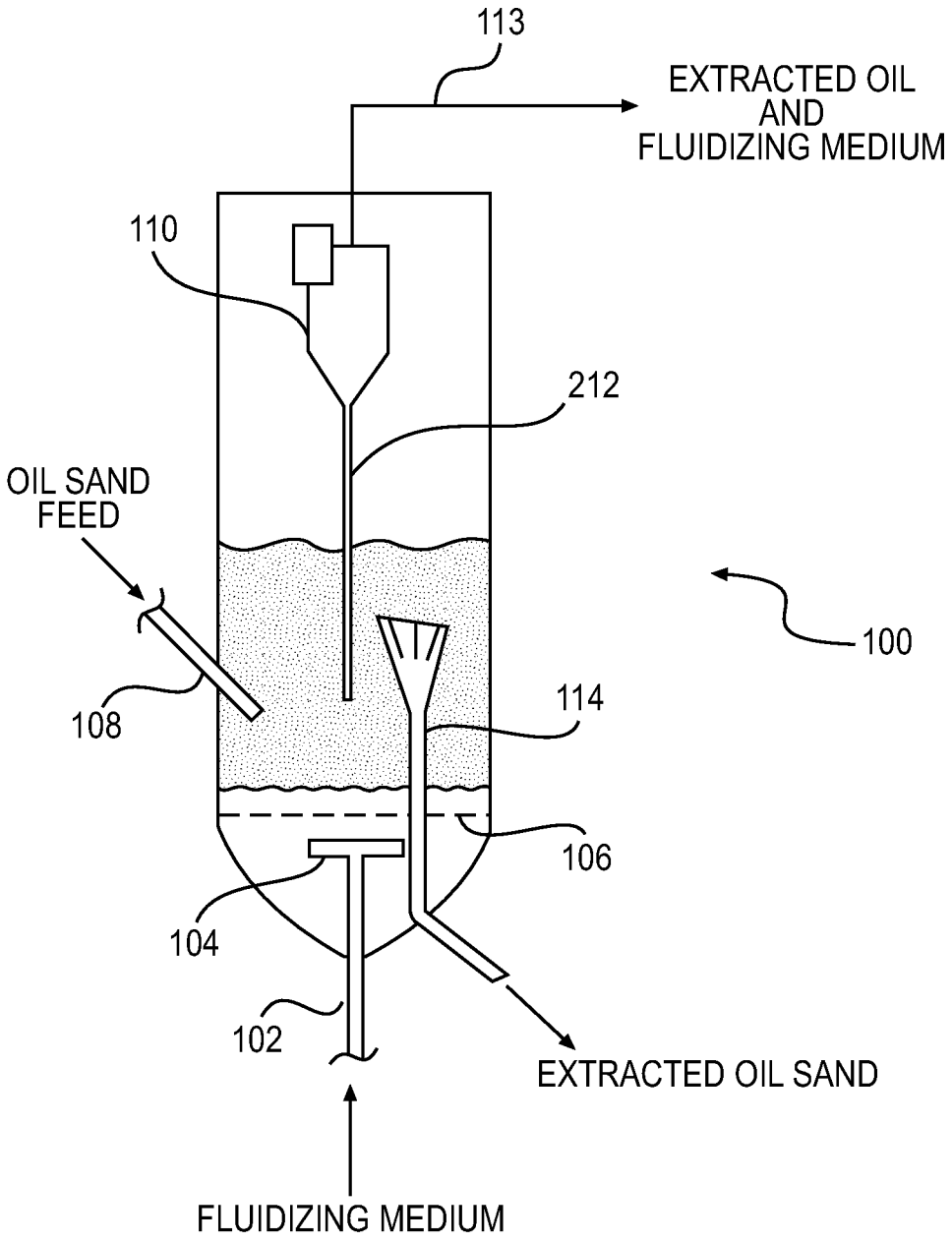
FIG. 1 is a process flow diagram of a dense phase fluidized bed embodiment according to the invention.

This invention provides a process for extracting an oil composition from oil sand. The extraction process is carried out using a fluidizing medium to fluidize oil sand particles within a contact zone in which the fluidizing medium contacts the oil sand and maintains the oil sand in the fluidized state. At least a majority of the fluidizing medium is in a vapor or supercritical state within the contact zone. The fluidizing medium, which is comprised of an appropriate hydrocarbon fraction, removes or extracts at least a portion of the oil composition from the oil sand in the contacting zone.

The extraction process is particularly effective in that the time required for removing substantial quantities of oil from the oil sand is relatively short. The quality of the extracted oil can also be controlled as desired by adjusting such parameters as hydrocarbon quality of the fluidizing medium and/or degree of vaporization of the fluidizing medium in the contacting zone.

Environmental impact of the process is relatively low in that little waste water is produced. Typically, only water that may be contained on the oil sand feed may be produced as a waste component. However, waste water content will be very low.

Another environmental benefit of carrying out the extraction process according to the steps of this invention is that extracted sand will have little if any added environmental impact relative to its native state. Since the process uses a fluidizing medium comprised of hydrocarbon as the extraction fluid, the extracted sand can be recovered in a relatively dry state and discarded with little if any increase in environmental impact.

II. Oil Sand

Oil can be extracted from any oil sand according to this invention. The oil sand can also be referred to as tar sand or bitumen sand. Additionally, the oil sand can be characterized as being comprised of a porous mineral structure, which contains an oil component. The entire oil content of the oil sand can be referred to as bitumen. Bitumen can be comprised of numerous oil components. For example, bitumen can be comprised of a flowable oil component, various volatile hydrocarbons and various non-volatile hydrocarbons, such as asphaltenes. Oil sand can be relatively soft and free flowing, or it can be very hard or rock-like, while the bitumen content may vary over a wide range.

One example of an oil sand from which an oil composition, including bitumen, can be extracted according to this invention can be referred to as water wet oil sand, such as that generally found in the Athabasca deposit of Canada. Such oil sand can be comprised of mineral particles surrounded by an envelope of water, which may be referred to as connate water. The bitumen of such water wet oil sand may not be in direct physical contact with the mineral particles, but rather formed as a relatively thin film that surrounds a water envelope around the mineral particles.

Another example of oil sand from which an oil composition, including bitumen, can be extracted according to this invention can be referred to as oil wet oil sand, such as that generally found in Utah. Such oil sand may also include water. However, these materials may not include a water envelope barrier between the bitumen and the mineral particles. Rather, the oil wet oil sand can comprise bitumen in direct physical contact with the mineral component of the oil sand.

The process of this invention includes a step of supplying a feed stream of oil sand to a contact zone, with the oil sand being comprised of at least 2 wt % of an oil composition, based on total weight of the supplied oil sand. Preferably, the oil sand feed is comprised of at least 4 wt % of an oil composition, more preferably at least 6 wt % of an oil composition, still more preferably at least 8 wt % of an oil composition, based on total weight of the oil sand feed.

Oil sand can have a tendency to clump due to some stickiness characteristics of the oil component of the oil sand. The oil sand that is fed to the contact zone should not be stuck together such that fluidization of the oil sand in the contact zone or extraction of the oil component in the contact zone is significantly impeded. In one embodiment, the oil sand that is provided or fed to the contact zone has an average particle size of not greater than 20,000 microns. Alternatively, the oil sand that is provided or fed to the contact zone has an average particle size of not greater than 10,000 microns, or not greater than 5,000 microns, or not greater than 2,500 microns.

As a practical matter, the particle size of the oil sand feed material should not be extremely small. For example, it is preferred to have an average particle size of at least 100 microns. However, the process of this invention is also particularly suited to treating oil sand separating extracted oil sand that is of relatively small diameter. The separated material can also be referred to as fine tailings. Fine tailings can be effectively separated from the product, since the extraction is carried out in a largely vapor or supercritical state. These fine tailings will also be of low environmental impact, since they can be separated in a relatively dry state and deposited as a substantially non-hazardous solid waste material.

III. Fluidizing Medium

The fluidizing medium used according to this invention is comprised of hydrocarbon. Hydrocarbon according to this invention refers to any chemical compound that is comprised of at least one hydrogen and at least one carbon atom. Preferably, the fluidizing medium is comprised of at least 20 wt % hydrocarbon. Alternatively, the fluidizing medium is comprised of at least 40 wt % hydrocarbon, or at least 60 wt % hydrocarbon, or at least 80 wt % hydrocarbon.

The fluidizing medium can further comprise hydrogen or inert components. The inert components are considered compounds that are substantially unreactive with the hydrocarbon component or the oil components of the oil sand at the conditions at which the fluidizing medium is used in any of the steps of the process of the invention. Examples of such inert components include, but are not limited to, nitrogen and steam. Hydrogen may or may not be reactive with the hydrocarbon or oil components of the oil sand at the conditions at which the fluidizing medium is used in any of the steps of the process of the invention.

At least a majority, i.e., at least 50 wt %, of the fluidizing medium in the contact zone is in a vapor or supercritical state. Alternatively, at least 70 wt %, or at least 80 wt %, or at least 90 wt % of the fluidizing medium in the contact zone is in a vapor or supercritical state.

The hydrocarbon of the fluidizing medium can be comprised of at least one hydrocarbon compound having from 1 to 20 carbon atoms. In an alternative embodiment, the hydrocarbon of the fluidizing medium is comprised of at least one hydrocarbon compound having from 1 to 10, alternatively from 1 to 8, carbon atoms. Examples of such hydrocarbons include aliphatic hydrocarbons, olefinic hydrocarbons and aromatic hydrocarbons. Particular aliphatic hydrocarbons include paraffins as well as halogen-substituted paraffins. Examples of particular paraffins include, but are not limited to propane, butane and pentane. Examples of halogen-substituted paraffins include, but are not limited to chlorine and fluorine substituted paraffins, such as $C_1$-$C_6$ chlorine or fluorine substituted or $C_1$-$C_3$ chlorine or fluorine substituted paraffins.

The hydrocarbon component of the fluidizing medium can act as a complete or partial solvent for removing the oil from the oil sand in that one or more hydrocarbons can be selected according to the degree of oil component that is desired to be extracted from the oil sand feed. In cases where it is desired to have a lower quantity of asphaltene components in the extracted oil, higher aliphatic concentrations are used. For example, the fluidizing medium can be comprised of hydrocarbon in which at least 50 wt % of the hydrocarbon is aliphatic hydrocarbon, based on total weight of the fluidizing medium. Alternatively, the fluidizing medium can be comprised of hydrocarbon in which at least 60 wt %, or at least 70 wt %, or at least 80 wt % of the hydrocarbon is aliphatic hydrocarbon, based on total weight of the fluidizing medium.

In an alternative embodiment, the fluidizing medium is comprised of aromatic hydrocarbon. Such a medium has a further advantage of more readily extracting non-volatile components such as asphaltenes from the oil sand feed. For example, the fluidizing medium can be comprised of hydrocarbon in which not greater than 30 wt % of the hydrocarbon is aromatic hydrocarbon, based on total weight of the fluidizing medium. Alternatively, the fluidizing medium can be comprised of hydrocarbon in which not greater than 20 wt %, or not greater than 10 wt % of the hydrocarbon is aromatic hydrocarbon, based on total weight of the fluidizing medium.

In another alternative embodiment, the fluidizing medium is comprised of olefinic hydrocarbon. For example, the fluidizing medium can be comprised of hydrocarbon in which not greater than 10 wt % of the hydrocarbon is olefinic hydrocarbon, based on total weight of the fluidizing medium. Alternatively, the fluidizing medium can be comprised of hydrocarbon in which not greater than 6 wt %, or not greater than 4 wt % of the hydrocarbon is olefinic hydrocarbon, based on total weight of the fluidizing medium.

The hydrocarbon of the fluidizing medium has an initial boiling point that is sufficiently low so that the hydrocarbon in the fluidizing medium can more easily be in the vapor or supercritical state in the contact zone. For example, the hydrocarbon can have an initial boiling point of at least −50° C. Higher initial boiling points can also be accommodated. For example, the hydrocarbon can have an initial boiling point of at least −10° C., or at least 0° C., or at least 10° C.

The hydrocarbon of the fluidizing medium should not have a boiling point that is high so that at least a majority of the hydrocarbon in the contact zone is not in the liquid or solid state. It is preferred that the hydrocarbon in the fluidizing medium have a final boiling point of not greater than 700° C. Alternatively, the hydrocarbon in the fluidizing medium has a final boiling point of not greater than 500° C., or not greater than 300° C., or not greater than 100° C.

The solvent can be a blend of hydrocarbon compounds. In such a case, the boiling range of solvent compounds useful according to this invention, as well as the crude oil compositions produced according to this invention, can be determined by batch distillation according to ASTM D86-09e1, Standard Test Method for Distillation of Petroleum Products at Atmospheric Pressure.

In one embodiment, the solvent has an ASTM D86 10% distillation point of at least −45° C. Alternatively, the solvent has an ASTM D86 10% distillation point of at least −40° C., or at least −30° C. The solvent can have an ASTM D86 10% distillation point within the range of from −45° C. to 50° C., alternatively within the range of from −35° C. to 45° C., or from −20° C. to 40° C.

The solvent can have an ASTM D86 90% distillation point of not greater than 300° C. Alternatively, the solvent has an ASTM D86 90% distillation point of not greater than 200° C., or not greater than 100° C.

The solvent can have a significant difference between its ASTM D86 90% distillation point and its ASTM D86 10% distillation point. For example, the solvent can have a difference of at least 10° C. between its ASTM D86 90% distillation point and its ASTM D86 10% distillation point, alternatively a difference of at least 20° C., or at least 30° C. However, the difference between the solvent's ASTM D86 90% distillation point and ASTM D86 10% distillation point should not be so great such that efficient recovery of solvent from extracted crude is impeded. For example, the solvent can have a difference of not greater than 60° C. between its ASTM D86 90% distillation point and its ASTM D86 10% distillation point, alternatively a difference of not greater than 50° C., or not greater than 40° C.

IV. Contact Zone Conditions

The fluidizing medium is input or supplied to the contact zone so as to fluidize the oil sand in the contact zone. In other words, contact of the fluidizing medium with oil sand particles causes the oil sand particles to form a fluidized bed. A fluidized bed is a bed of particles in which the bed behaves as a fluid.

Any type of fluidized bed can be formed from the fluidization step of this invention. Examples include, but are not limited to, expanded beds (particles move apart, with at least a portion of the particles vibrating or moving about in a relatively restricted manner); incipiently fluidized beds (where frictional force between a particle and the fluidizing medium counterbalances the weight of the particle, the vertical component of the compressive force between adjacent particles goes to zero, and, optionally, the pressure drop through any section of the bed is approximately equal to the weight of the fluidizing medium and particles across that section); bubbling fluidized beds (occurs where there is a relatively progressive expansion of the bed, with some associated bubbling or channeling formation in the bed); dense-phase fluidized bed (includes higher flow rates of fluidizing medium through the contact zone, preferably with less bubbling and channeling formation than in bubbling fluidized beds and with a relatively defined upper limit or surface to the bed); and dilute-phase fluidized beds (occurs at relatively high flow rates of fluidizing medium through the contact zone, where the terminal velocity of the particles are exceeded, there is no clearly defined upper bed limit or surface, and a substantial portion of the particles are removed from the contact zone along with the fluidizing medium).

The fluidizing medium is provided to the contact zone a superficial velocity sufficient to fluidize the oil sand particles within the contact zone. Superficial velocity is considered the volumetric flow rate of the fluidizing medium moving through the contact zone divided by the cross-sectional area of the contact zone. Since cross-sectional area may vary in the contact zone, the superficial velocity can vary within the contact zone. However, the superficial velocity at any given point within the contact zone will be sufficient to ensure fluidization.

The superficial velocity can also vary depending upon particle size. The larger the particle size, the greater the superficial velocity. Preferably, the superficial velocity in the contact zone is greater than or equal to 0.1 meter per second (m/s). As particle size of the oil sand may be larger, the superficial velocity in the contact zone may be greater than or equal to 0.2 m/s, or greater than or equal to 0.5 m/s, or greater than or equal to 1 m/s, or greater than or equal to 5 m/s.

In cases where it is desired to form a fluidized bed having a relatively defined upper bed limit or surface of oil sand particles, i.e., fluidized beds other than a dilute-phase fluidized bed, superficial velocity is reduced. For example, in such case, superficial velocity may be not greater than 10 m/s or not greater than 5 m/s.

Fluidizing medium and oil sand is supplied to the contact zone at a weight ratio of total hydrocarbon in the fluidizing medium to total weight of oil sand feed to the contact zone that is effective for removing or extracting at least a portion of the oil composition from the oil sand feed. Preferably, the fluidizing medium and oil sand are supplied to the contact zone at a weight ratio of total hydrocarbon to oil sand feed of at least 0.01:1, or at least 0.1:1, or at least 0.5:1 or at least 1:1.

The hydrocarbon to oil sand feed ratio can vary according to a variety of variables. Such variables include, but are not limited to, solubility of the hydrocarbon in the oil composition, temperature and pressure of the contact zone, and contact time of hydrocarbon and oil sand in the contact zone.

Temperature should be sufficiently high to keep contact time at an acceptable level. Preferably, temperature in the contact zone is at least 30° C. Alternatively, temperature in the contact zone is at least 40° C., or least 50° C., or least 100° C., or least 150° C. However, temperature in the contact zone should not be so high as to cause any significant degradation or cracking of the hydrocarbon or the oil component of the oil sand. It is preferred that the temperature in the contact zone be not greater than 700° C. Alternatively, the temperature in the contact zone is not greater than 500° C., or not greater than 300° C., or not greater than 200° C.

Pressure in the contact zone is maintained in conjunction with the temperature to ensure that the fluidizing medium is maintained at the desired vapor or supercritical condition. Lower pressures are desired, although higher pressures will be needed in cases where the hydrocarbon in the fluidizing medium is characterized by lower boiling points. Preferably, the pressure in the contact zone is equal to or greater than atmospheric pressure. Alternatively, the pressure in the contact zone is at least 15 psia (103 kPa), or at least 25 psia (172 kPa), or at least 50 psia (345 kPa), or at least 100 psia (689 kPa), or at least 150 psia (1034 kPa). Upper limits are determined according to practical equipment design. An example is that the pressure in the contact zone is not greater than 1500 psia (10340 kPa), due to cost constraints.

V. Separation of Extracted Oil from Extracted Sand

Separation can be by any suitable means for separating solid from vapor and/or liquid. For example, separation can be by mechanical separation means such as gravity or knock out drum, centrifugal separator (including cyclone separator), impingement separator (including wire mesh or mesh pad separator and vane type separator), and filter separator.

In an embodiment, fluidization medium is provided or injected into the contact zone, where the fluidizing medium contacts the oil sand feed to fluidize the feed and extract at least a portion of the oil composition from the oil sand feed. Both a majority of the fluidizing medium and a majority of the extracted oil composition are in the vapor phase and are separated by a suitable separation device.

The extracted oil sand has some remaining oil composition originally present in the oil sand. However, the oil sand is substantially dry, meaning the extracted oil sand has not greater than 8 wt %, preferably not greater than 6 wt %, water, based on total weight of the extracted sand. This extracted sand is relatively non-hazardous and can be redeposited from its original site.

The extracted oil composition can vary in composition characteristics, based on a number of variable parameters in the overall process, including but not limited to, the quality and content of the hydrocarbon in the fluidizing medium, the temperature and pressure in the contact zone, and the relative rate of flow of the fluidizing medium and oil sand feed through the contact zone. For example, the extracted oil composition can have an API gravity of not less than 5. Alternatively, the extracted oil composition can have an API gravity of not less than 8, or not less than 12, nor not less than 15, or not less than 17.

The extracted oil composition can also be relatively low in sulfur content. For example, the extracted oil composition can have a sulfur content of not greater than 5 wt %, based on total weight of the extracted oil composition. Alternatively, the extracted oil composition can have a sulfur content of not greater than 3 wt %, or not greater than 1 wt %, or not greater than 0.5 wt %, based on total weight of the extracted oil composition.

The degree of extraction of oil from the oil sand can be controlled as desired. For example, the process can be carried out to extract not greater than 30 wt %, or not greater than 40 wt %, or not greater than 50 wt %, or not greater than 60 wt %, or not greater than 70 wt % of the total oil composition present on the oil sand feed.

Following extraction of the oil from the oil sand, solvent can be separated from the extracted oil and recovered or recycled. For example, temperature and pressure can be controlled to maintain the solvent at the desired vapor and/or supercritical conditions within the contacting zone of the extraction vessel, along with maintaining the contacting zone at the desired fluidized bed conditions, and separate the desired degree of oil from the oil sand. The separated oil can be separated from the remaining oil sand under such conditions so that at least 30 wt %, or at least 40 wt %, or at least 50 wt %, or at least 60 wt %, or at least 70 wt % of the oil composition originally present on the oil sand remains with the oil sand. The extracted oil can then be separated from the remaining oil sand.

The extracted oil can be further separated into an oil product fraction and a solvent fraction. The oil product can have the characteristics of the extracted oil described above and the solvent product fraction can have the characteristics of the fluidizing medium as described above.

The solvent fraction can be recovered for additional use. For example, the solvent fraction can be recycled and used as fluidizing medium to contact and fluidize the oil sand feed such that little if any fluidizing medium or hydrocarbon solvent make up is needed. Such a recycle is capable of carrying out a continuous oil separation process, with hydrocarbon solvent make up or fresh hydrocarbon solvent being only a fraction of the hydrocarbon in the fluidizing medium used to contact the oil sand feed. Preferably, make up hydrocarbon constitutes not greater than 5 wt %, more preferably not greater than 3 wt %, and most preferably not greater than 1 wt % of the total weight of the fluidizing medium used in the contacting zone to extract the oil from the oil sand. In other words, the solvent fraction that is recycled can comprise at least 95 wt %, or at least 97 wt %, or at least 99 wt % of the total fluidizing within the contact zone.

By controlling the degree of extraction of oil composition present on the oil sand feed, extraction of non-volatile oil compounds in the oil composition present on the oil sand feed can also be controlled. For example, the process can produce an extracted oil composition having not greater than 14 wt % non-volatile oil compounds. Alternatively, the process can produce an extracted oil composition having not greater than 10 wt %, or not greater than 6 wt %, or not greater than 2 wt %, or not greater than 1 wt %, or not greater than 0.5 wt %, non-volatile oil compounds. An example of non-volatile compounds includes ashphaltenes.

VI. Examples:

Example 1

Dense Phase Fluidized Bed

One embodiment of the overall process of this invention is shown in FIG. 1, in which the process is carried out in an extraction vessel 100. Fluidizing medium comprised of hydrocarbon is injected into the vessel 100 by way of a line 102. The fluidizing medium passes through a manifold 104 and through a distribution plate 106 to contact oil sand that is input into the vessel 100 by way of a line 108 and contacts the oil sand feed above the distribution plate. Essentially the entire region within the vessel 100 and above the distribution plate is considered the contact zone in this embodiment.

In this embodiment, the superficial velocity of the fluidizing medium is determined so maintain the oil sand as a dense phase fluidized bed. The hydrocarbon in the fluidizing medium will act to extract at least a portion of the oil composition from the oil sand feed, while the flow of fluidizing medium through the vessel 100 will maintain the oil sand in the fluidized state.

Extracted oil and fluidizing medium will pass up through the vessel 100, along with oil sand fines. The combination of materials will pass into cyclone separator 110, where solids will be separated from non-solid material. The extracted solids will be returned back to the dense phase fluidized bed by way of a dipleg 112, while extracted oil and fluidizing medium is removed from the vessel 100 by way of line 113. To maintain a continuous operation, a solids removal line 114 will remove extracted oil sand from an upper portion of the fluidized bed. This extracted oil sand can be discarded as non-hazardous waste.

Example 2

Dilute Phase Fluidized Bed

Figure 2:
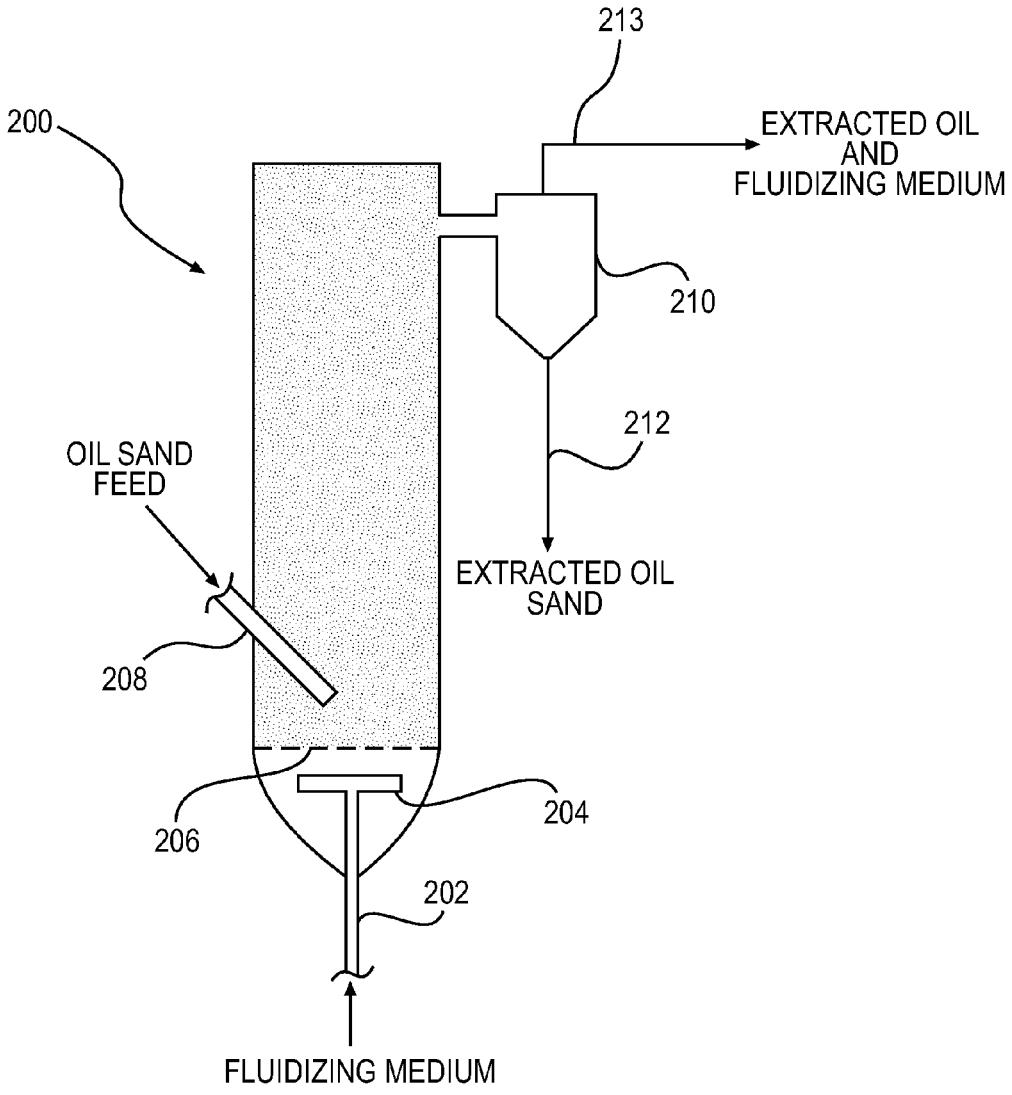
FIG. 2 is a process flow diagram of a dilute phase fluidized bed embodiment according to the invention.

Another embodiment of the overall process of this invention is shown in FIG. 2, in which the process is carried out in an extraction vessel 200. Fluidizing medium comprised of hydrocarbon is injected into the vessel 200 by way of a line 202. The fluidizing medium passes through a manifold 204 and through a distribution plate 206 to contact oil sand that is input into the vessel 200 by way of a line 208 and contacts the oil sand feed above the distribution plate. Essentially the entire region within the vessel 200 and above the distribution plate is considered the contact zone in this embodiment.

In this embodiment, the superficial velocity of the fluidizing medium is determined so maintain the oil sand as a dilute phase fluidized bed. The hydrocarbon in the fluidizing medium will act to extract at least a portion of the oil composition from the oil sand feed, while the flow of fluidizing medium through the vessel 200 will maintain the oil sand in the fluidized state.

Extracted oil and fluidizing medium will pass up through the vessel 200, along with extracted oil sand. The combination of materials will pass into cyclone separator 210, where solids will be separated from non-solid material. The extracted solids will be discarded by way of line 212, while extracted oil and fluidizing medium is removed from the vessel 100 by way of line 213.

Example 3

Extraction of Oil Composition Using Propane as Fluidizing Medium

A sample of oil sand or ore (Canadian—Athabasca) was used as the feedstock. The bitumen content was measured at 13.6 wt % by the Dean Stark (Syncrude) method. The ore was sized so that the particles fed were typically 12-16 mesh.

After sizing, the feedstock ore was sent via a conveyer belt to a feed bin located above the extraction vessel. The extraction vessel was an auger pump with extended chambers, which act as a zone in which solvent contacts feedstock. An example of such an auger is shown in U.S. Pat. No. 7,384,557.

The hydrocarbon solvent employed was propane gas (99.5% purity). The extraction vessel was pressurized to a range of ~100 to ~170 psi and at a temperature in the range of ~65-95 degrees Fahrenheit, with the pressure and temperature controlled so that the solvent was substantially in the vapor phase in the region of the vessel in which the solvent initially contacted the feedstock. The auger was turned at a rate such that at the conditions of the run, the system feedstock was significantly in a fluidized state in the contact zone of the vessel.

The feed, extracted oil, solvent and extracted sand (i.e., tailings) were brought through the auger driven extraction vessel. At the back end of the extraction vessel, additional propane gas was introduced at a pressure and temperature slightly higher than the pressure and temperature within the extraction vessel. This step was taken to strip off remaining oil from the particles. The various product streams were collected.

A yield of 49 wt % of extracted oil (based on bitumen content measured before and after the run) was obtained. This oil had 87.0% carbon, 13.2% hydrogen (H/C=1.82), 3.06% sulfur and an API gravity of 15.1. Pentane asphaltenes were 0.04% and microcarbon residue was 0.04%.

The principles and modes of operation of this present techniques have been described above with reference to various exemplary and preferred embodiments. As understood by those of skill in the art, the overall present techniques, as defined by the claims, encompasses other preferred embodiments not specifically enumerated herein.

The invention claimed is:

1. A low waste water and environmental impact process for separating a low asphaltene oil product fraction from oil sand, comprising;

a) supplying a stream of oil sand to a contact zone, wherein the oil sand is comprised of at least 8 wt % of a bitumen oil composition, based on total weight of the supplied oil sand;

b) fluidizing the oil sand in the contact zone in the presence of a fluidizing medium, wherein the fluidizing medium is comprised of a hydrocarbon solvent containing at least 80 wt % of at least one aliphatic hydrocarbon selected from the group consisting of propane and butane, at least a majority of the fluidizing medium in the contact zone is maintained in a vapor state at a contact zone pressure of at least 50 psia and a contact zone temperature of not greater than 200 ° C. and the contacting of the fluidizing medium with the oil sand extracts not greater than 70 wt % of the bitumen oil composition from the oil sand within the contacting zone to form an extracted oil portion, an oil-extracted oil sand portion, and, optionally, a waste water component, wherein the waste water component, when present, comprises only water contained in the oil sand supplied to the contact zone;

c) separating the extracted oil portion from the oil-extracted oil sand portion, wherein the separated oil-extracted oil sand portion is in a relatively dry state, comprising not greater than 8 wt % water, based on total weight of separated the oil-extracted oil sand;

d) separating the extracted oil portion is separated from the oil-extracted oil sand portion into the low asphaltene oil product fraction and a recycle solvent fraction, wherein the low asphaltene oil product fraction has a sulfur content of not greater than 5 wt % based on total weight of the extracted oil portion, an API gravity of not less than 15° and is comprised of not greater than 2 wt % asphaltenes; and e) recycling the separated recycle solvent fraction to the contact zone, wherein the fluidizing medium in the contact zone is further comprised of the recycled solvent fraction and not greater than 5 wt % of a hydrocarbon solvent make up, and the fluidizing medium in the contact zone has an ASTM D86 10% distillation point of at least −45°C. and an ASTM D86 90% distillation point of not greater than 100°C.

2. The process of claim 1 wherein the oil sand that is supplied to the contact zone has an average particle size of not greater than 20,000 microns.

3. The process of claim 1, wherein the fluidizing medium is provided to the contact zone at a superficial velocity greater than or equal to 0.1 meter per second (m/s).

4. The process of claim 3, wherein the superficial velocity is not greater than 10 m/s.

5. The process of claim 1, wherein the fluidizing medium and oil sand are supplied to the contact zone at a weight ratio of total hydrocarbon to oil sand feed of at least 0.01:1.

6. The process of claim 1, wherein the at least one aliphatic hydrocarbon is propane.

7. The process of claim 6, wherein the hydrocarbon solvent is comprised of not greater than 10 wt % aromatic hydrocarbon.

8. The process of claim 2, wherein fluidizing is carried out in a vessel having a fluidized bed configuration selected from the group consisting of expanded beds, incipiently fluidized beds, bubbling fluidized beds, dense-phase fluidized beds and dilute-phase beds.

9. The process of claim I, wherein fluidizing is carried out in an extraction vessel containing an auger configured to fluidize the oil sand with the fluidizing medium.

10. The process of claim 1, wherein the fluidizing medium in the contact zone is maintained in a vapor state at a contact zone pressure of at least 100 psia.

* * * * *